US012502576B1

(12) United States Patent
Carter

(10) Patent No.: US 12,502,576 B1
(45) Date of Patent: Dec. 23, 2025

(54) AEROBIC STEP PLATFORM ASSEMBLY

(71) Applicant: One Strong Southern Girl LLC, Paris, TN (US)

(72) Inventor: Mickie Carter, Paris, TN (US)

(73) Assignee: One Strong Southern Girl LLC, Paris, TN (US)

( * ) Notice: Subject to any disclaimer, the term of this patent is extended or adjusted under 35 U.S.C. 154(b) by 0 days.

(21) Appl. No.: 17/733,684

(22) Filed: Apr. 29, 2022

(51) Int. Cl.
*A63B 23/04* (2006.01)

(52) U.S. Cl.
CPC .... *A63B 23/0458* (2013.01); *A63B 2225/093* (2013.01)

(58) Field of Classification Search
CPC ..... A63B 23/0458; A63B 2225/093
See application file for complete search history.

(56) References Cited

U.S. PATENT DOCUMENTS 5,125,646 A * 6/1992 Wilkinson ..... A47C 12/02 482/52
D330,057 S 10/1992 Saunders et al.
D330,234 S 10/1992 Saunders et al.
5,154,678 A * 10/1992 Adamczyk ..... A63B 23/0458 482/52
5,158,512 A 10/1992 Irwin et al.
5,162,028 A 11/1992 Wilkinson
5,169,360 A 12/1992 Saunders
5,184,987 A 2/1993 Wilkinson
5,213,554 A 5/1993 Goldstein et al.
5,226,865 A 7/1993 Chin
5,234,396 A 8/1993 Wilkinson
5,261,864 A 11/1993 Fitzpatrick
5,290,210 A 3/1994 Hand et al.
5,318,489 A 6/1994 Irwin
5,352,168 A * 10/1994 Wilkinson ..... A63B 23/0458 248/188.8
5,387,166 A * 2/1995 Gvoich ..... A63B 21/4029 482/52
5,441,466 A 8/1995 Piaget et al.
5,562,575 A 10/1996 Gvoich
5,584,779 A 12/1996 Knecht et al.
5,651,753 A 7/1997 Wilkinson
5,672,144 A * 9/1997 Hulme ..... A63B 23/0211 482/91
6,117,051 A * 9/2000 Suarez ..... A63B 21/4037 52/142

(Continued)

*Primary Examiner* — Andrew S Lo
(74) *Attorney, Agent, or Firm* — Hanrahan Law Firm, P.A.; Benjamin M. Hanrahan, Esq.

(57) ABSTRACT

An aerobic step platform assembly is presented herein. The assembly includes a main step platform defining a top surface and a bottom surface, and a plurality of risers each defining a top attachment surface and a bottom surface. The top attachment surface of each riser is removably connected to the bottom surface of the main step platform via an attachment assembly which includes a male portion and a female portion. The male portion includes a peg extending from a surrounding recess, whereas the female portion includes a collar defining a receiving hole. When the attachment assembly is interlocked the peg of the male portion is cooperative with the receiving hole of the collar of the female portion, and the collar of the female portion is cooperative with the surrounding recess of the male portion.

6 Claims, 10 Drawing Sheets

(56) References Cited

U.S. PATENT DOCUMENTS

| | | | | | |
|---|---|---|---|---|---|
| D449,357 | S | * | 10/2001 | Monter Villar | D21/686 |
| D449,662 | S | * | 10/2001 | Monter Villar | D21/686 |
| 8,348,812 | B2 | | 1/2013 | Elpers | |
| 9,011,295 | B2 | | 4/2015 | Orenstein et al. | |
| D775,285 | S | | 12/2016 | Irwin et al. | |
| 10,252,103 | B2 | * | 4/2019 | Irwin | B32B 3/30 |
| 10,894,183 | B2 | | 1/2021 | Irwin et al. | |
| 2006/0040796 | A1 | | 2/2006 | Holloway | |
| 2006/0189448 | A1 | * | 8/2006 | Flentye | A63B 23/0458 482/52 |
| 2006/0189449 | A1 | | 8/2006 | Flentye et al. | |
| 2007/0087902 | A1 | | 4/2007 | Penat et al. | |
| 2011/0207583 | A1 | * | 8/2011 | Elpers | A63B 23/0458 482/52 |
| 2011/0256987 | A1 | * | 10/2011 | Lepore | A63B 23/0458 482/52 |
| 2014/0051553 | A1 | * | 2/2014 | Hetzel | A63B 21/0004 482/52 |
| 2016/0199689 | A1 | * | 7/2016 | Irwin | B32B 21/047 482/142 |
| 2016/0303422 | A1 | * | 10/2016 | Douglass | A63B 21/4033 |
| 2017/0080284 | A1 | * | 3/2017 | Hillson | A63B 21/4033 |

* cited by examiner

AEROBIC STEP PLATFORM ASSEMBLY

FIELD OF THE INVENTION

The present invention is generally directed to an aerobic step platform assembly, and more specifically, to an aerobic step platform assembly that includes a plurality of risers that are removably connected to a main platform via a cooperatively coupled, interlocking or nesting attachment assembly that provides a secure connection therebetween.

BACKGROUND OF THE INVENTION

Aerobic exercise or aerobic activities can be defined as physical exercise involving virtually any level of intensity (e.g., from low intensity to high intensity) that provides cardiovascular conditioning of various forms. Aerobic exercise can, for example, but need not necessarily include the performance of a repetitive sequence of activities over an extended period of time.

In this manner, step aerobics is a form of an aerobic exercise that can involve the repetitive stepping on and off of a raised platform, or otherwise using a raised platform during an exercise routine that provides cardiovascular conditioning. There are several different routines or exercise programs that can be performed using a raised or step platform, for example, depending on the desired level of intensity or expertise. As an example, one way to increase the intensity level of an exercise routine using a step platform may be to include weights (e.g., held by the exerciser as he/she steps on and off of the platform). Accordingly, in addition to providing an aerobic workout, some routines that utilize a step platform can also provide strength training and other forms of exercise.

Another way to increase the intensity level or expertise level of an exercise routine using a step platform may be to increase the height of the platform, thereby requiring the exerciser to step higher during the routine. In this manner, one or more risers can be placed under the step platform to raise the platform higher, and therefore, to increase the intensity of the workout or exercise routine. However, adding risers beneath the step platform can be dangerous, particularly in the event the risers are not secured or interlocked in some manner to the main platform or to each other. More specifically, the risers should be securely held in place under and to the platform, otherwise the risers can create an unstable and therefore dangerous surface or environment, even during the performance of a low intensity workout.

There is, therefore, a need in the art for an aerobic step platform assembly that provides a secure and stable connection between a main platform (upon which the exerciser will step) and removably attached risers that can be easily added or removed to selectively adjust the height the assembly. It would also be beneficial if, in addition to providing a secure and stable interconnection with the main platform, the risers are easily disconnected or removed, only when desired, in order to allow an exerciser or user to quickly and easily adjust the height of the platform assembly in between exercise routines or even during an exercise routine.

SUMMARY OF THE INVENTION

Accordingly, the present invention is directed to an aerobic step platform assembly with an interlocking or interconnecting attachment assembly that provides a secure and movement restricting connection between a main step platform and at least one, although in many cases a plurality of risers. In particular, the aerobic step platform assembly of at least one embodiment includes an elongated main step platform defining a top surface and a bottom attachment surface. A plurality of risers are also included, each of which define a top attachment surface and a bottom attachment surface. As described in accordance with the various embodiments of the present invention, the risers are removably connectable to the main platform, or to one another, via an interconnecting, interlocking and/or nesting attachment assembly.

More specifically, the attachment assembly is defined as including cooperatively structured portions, at least one portion being formed on or mounted to the main platform, and at least another portion being formed on or mounted to the riser. In some embodiments, the attachment assembly includes a first portion that can also be referred to as a male portion and a second portion that can also be referred to as a female portion that are cooperatively structured such that the first and second portions are removably coupled or interlocked with one another.

In particular, the first or male portion of the attachment assembly of at least one embodiment includes a peg that extends from a surrounding recess formed on the top attachment surface of each of the plurality of risers. The second or female portion of the attachment assembly of at least one embodiment includes a grommet or other like structure that defines an exposed collar formed on the bottom surface of the main platform. The grommet or collar thereof includes a bore or receiving hole disposed at least partially there through and which cooperates with the peg of the first or male portion of the attachment assembly.

In this manner, when the first and second portions of the attachment assembly are coupled or interlocked with one another, the peg of the first or male portion is cooperative with or engaged within the receiving hole of the grommet, while the collar of the second or female portion is simultaneously cooperative with or engaged within the surrounding recess of the first or male portion.

Accordingly, when a plurality of first or male portions (e.g., formed on the top attachment surface of the riser(s)) is coupled to a plurality of second or female portions (e.g., formed on the bottom attachment surface of the main platform), lateral, side-to-side, and front-to-back movement between the interconnected or interlocked riser(s) and main platform is restricted via the attachment assembly. Removal of the main platform from the riser(s) or removal of the riser(s) from the main platform can be accomplished by axially pulling the component(s) apart.

Furthermore, in certain embodiments, the bottom surface of each of the risers may also include a plurality of attachment portions that are cooperative with and removably interconnectable to the top attachment surface of another riser. In other words, in the embodiment wherein the top attachment surface of the risers includes a plurality of first or male portions of the attachment assembly, as described above, then the bottom surface of the risers may include a plurality of female portions that are cooperative with the male portions. In this manner, a plurality of similarly constructed risers can be stacked upon one another to selectively adjust the height of the main platform a desired amount while maintaining the movement restricting connection of the attachment assembly.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
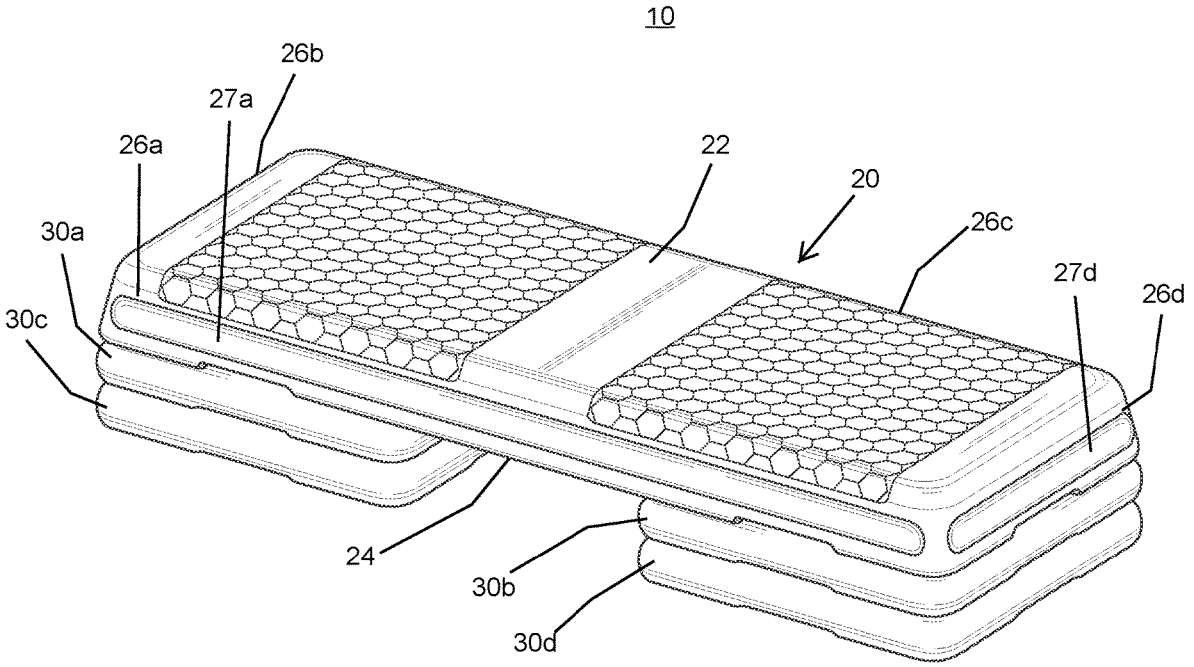
FIG. 1 is a front perspective view of the aerobic step platform assembly as disclosed in accordance with at least one embodiment of the present invention.
Figure 2:
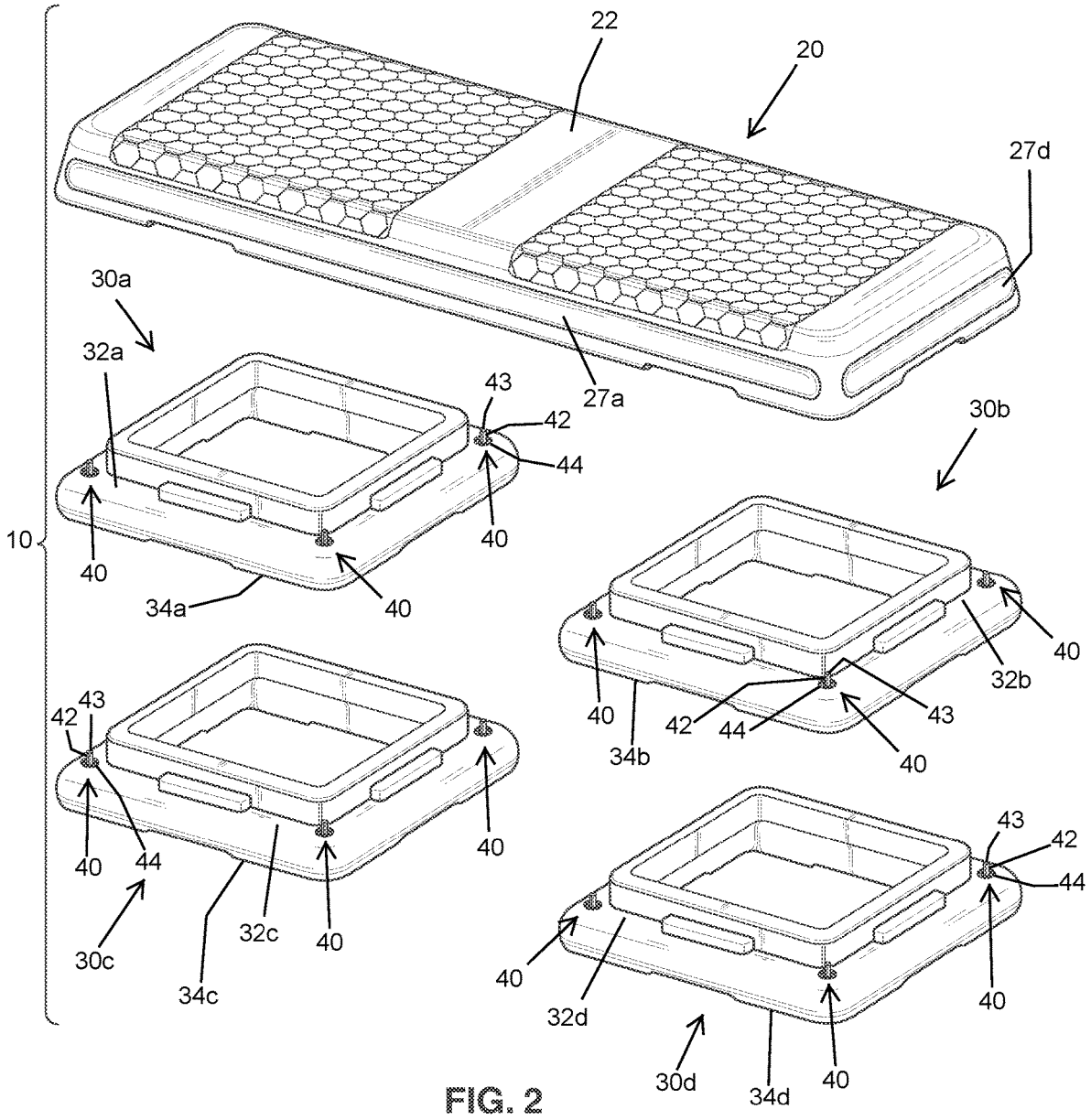
FIG. 2 is an exploded view of the aerobic step platform assembly as disclosed in accordance with at least one embodiment of the present invention.
Figure 3:
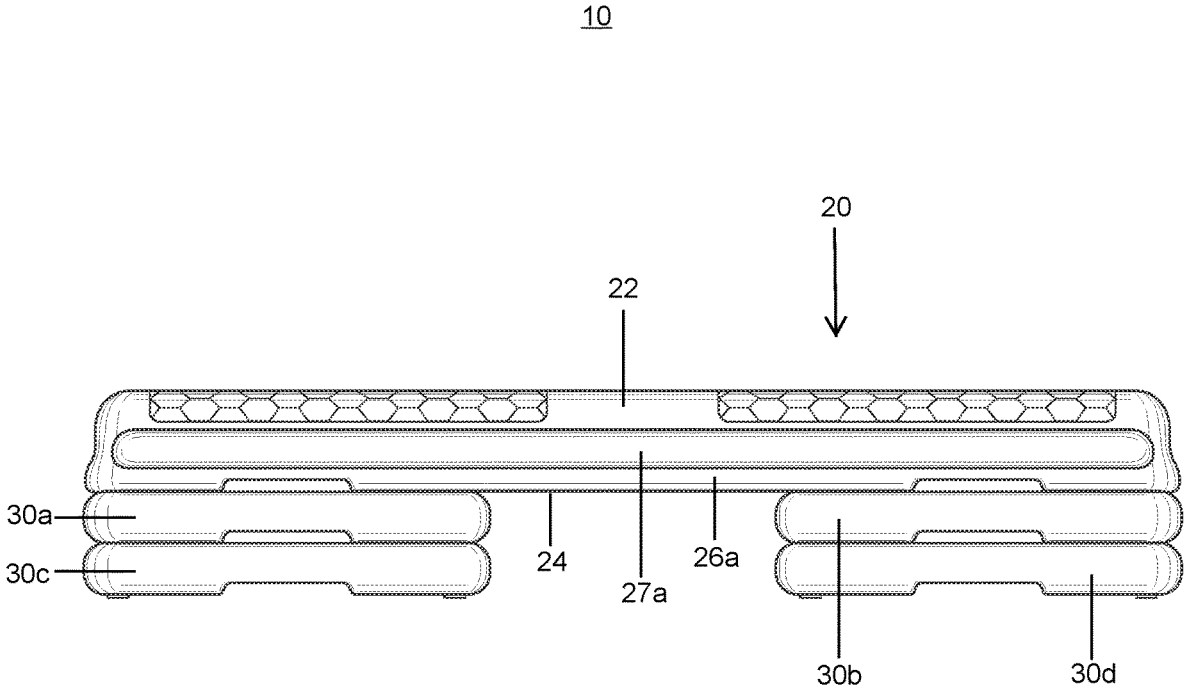
FIG. 3 is a front elevation view of the aerobic step platform assembly as disclosed in accordance with at least one embodiment of the present invention.

As shown in the accompanying drawings, and with particular reference to FIGS. 1 and 2, the present invention is directed to an aerobic step platform assembly, generally referenced as 10. In particular, the aerobic step platform assembly 10 of the various embodiments of the present invention includes a main step platform 20 and at least one riser 30*a-d*. As should be apparent herein, one or more of the risers 30 is/are removably connected, interconnected or otherwise nested with or attached to the main platform 20 in order to selectively raise, lower or otherwise adjust the height of the platform assembly 10 or in order to raise, lower or otherwise adjust the height of a portion or end of the platform assembly 10.

For instance, in at least one embodiment, and as shown in the Figures, one set or level of risers, for example as referenced by 30*a*, 30*b*, may be removably connected or attached to the main platform 20 in order to raise the height of the platform assembly 10 by an amount approximately equal to the height of one riser 30*a-d*. For example, one riser 30*a* may be connected to one side of the bottom surface of the main platform 20, while the other riser 30*b* may be connected to the other side of the bottom surface of the main platform 20.

In this example, and in the embodiment illustrated, the risers 30*a-d* are all of identical construction. However, it should be noted that in some embodiments, the risers 30*a-d* may have different heights, lengths, or shapes and still fall within the full spirit and scope of the present invention.

Furthermore, and still referring to FIGS. 1 and 2, for example, the height of the platform assembly 10 can be raised higher by connecting, interconnecting or otherwise attaching another set or a second level of risers, as generally represented as 30*c*, 30*d*, to the platform assembly 10. More specifically, the second set of risers 30*c*, 30*d* may be removably connected to the bottom surfaces of the first set of risers 30*a*, 30*b* in order to raise height of the platform assembly 10 by an additional amount approximately equal to the height of one riser 30*a-d* or the height of the second set or second layer of risers 30*c*, 30*d*.

Additional sets or levels of risers (not shown) can be added to the bottom of the aerobic step platform assembly 10 in order to raise the assembly 10 even higher, if desired.

It should also be noted that the risers 30*a-d* need not be connected to the main platform 20 or assembly 10 in lateral pairs or sets, for example, referencing the first set or level of risers as 30*a*, 30*b* and the second set or level of risers as 30*c*, 30*d*. In other words, if desired, one side of the main platform 20 may be raised higher than the other side, if, for example, more risers 30*a-d* are connected or interconnected to the main platform 20 or assembly 10 on one side. More specifically, the assembly 10 may be selectively arranged such that any number of risers 30*a-d* (zero or more) may be connected or interconnected to either one or both of the sides 22*a*, 22*b* of the main platform 20.

In another embodiment or example, a single riser may span the entire or substantially the entire length of the platform assembly 10 such a level of risers may be defined by a single elongated riser, rather than a set of two risers (e.g., 30*a*, 30*b* and 30*c*, 30*d*).

In any event, the main step platform 20 of at least one embodiment of the present invention comprises a top surface 22, a bottom surface 24, and a plurality of peripheral walls 26*a-d*. As should be apparent, the top surface 22 is the surface upon which a user will step during performance of one or more exercises using the step platform assembly 10 of the present invention, whereas the bottom surface 24 is opposite to the top surface 22 and generally faces in a downward direction during operative use of the platform assembly 10.

Additionally, each of the risers 30*a-d* of at least one embodiment include or otherwise define a top surface or a top attachment surface, referenced as 32*a-d*, and an opposing bottom surface or bottom attachment surface, referenced as 34*a-d*. As described and illustrated herein, the top attachment surfaces 32*a-d* of the risers 30*a-d* are selectively and removably attachable to the bottom surface 24 of the main platform 20 via an attachment assembly. More in particular, the attachment assembly of at least one embodiment of the present invention includes a plurality of first portions, for example male portions, represented as 40, and a plurality of cooperatively structured second portions, for example female portions, represented as 50. As described herein, the first, or male portions, and the second, or female portions, of the attachment assembly cooperate with one another in order to selectively connect or interconnect the riser(s) 30*a-d* to the main platform 20 and/or to one another in a stacked manner.

For instance, in at least one embodiment, and as illustrated in FIG. 2, the first or male portions 40 of the attachment assembly may be formed on or extend from the top attachment surfaces 32*a-d* of the risers 30*a-d*. In this manner, the cooperative second or female portions 50 of the attachment assembly may be formed on the bottom surface 24 of the main platform 20. It should also be noted that other embodiments may include a reverse configuration, for example, with the first or male portions 40 of the attachment assembly being formed on or extending from the bottom surface 24 of the main platform 20, and with the second or female portions 50 of the attachment assembly being formed on the top attachment surfaces 32*a-d* of the risers 30*a-d*.

Furthermore, still referring to FIG. 2, the first or male portions 40 of the attachment assembly of at least one embodiment of the present invention include at least one peg, rod or pin, referenced as 42, which cooperatively engages with or connects to a corresponding second or female portion 50, as described herein. As shown, the peg 42 of the first or male portion 40 of the attachment assembly extends beyond an immediately surrounding or adjacent portion of the top attachment surface 32*a-d* to which the peg 42 is secured. This allows the peg 42 to extend into a corresponding second or female portion 50 of the attachment assembly, as described herein, although it should be noted that other configurations are contemplated.

Furthermore, and still referring to FIG. 2, the peg 42 of at least one embodiment of the present invention extends from a surrounding recess 44. More specifically, the recess 44 as used herein is defined as a depression, cavity or socket formed into the top attachment surface 32*a-d* of the riser 30*a-d*. In this manner, the first or male portion 40 of the attachment assembly of at least one embodiment of the present invention includes a recess 44 that dips into the top attachment surface 32*a-d*, and a peg 42 extending from the recess 44 and including a distal end 43 that is disposed beyond or above the immediately surrounding portion of the top attachment surface 32*a-d*. Put another way, the distal end 43 of the peg 42 may extend beyond a top circumferential edge 45 of the surrounding recess 44. In some cases, the top circumferential edge 45 of the recess 44 may meet at the immediately surrounding portion of the top attachment surface 32*a-d*. Accordingly, and in other words, in at least one embodiment, the peg 42 of the first or male portion 40 of the attachment assembly includes a length that is greater than a depth of the surrounding recess, thereby allowing the peg 42 to extend from the bottom surface of the recess and beyond the top circumferential edge 45 thereof.

Furthermore, the peg 42 of the exemplary embodiment is coaxial with the surrounding recess 44 in that the peg 42 extends from the center of the recess 44. However, in other embodiments (not illustrated), the peg 42 may not be coaxial with the surrounding recess 44 and may still fall within the full spirit and scope of the present invention.

Moreover, as shown in the exemplary embodiment of FIG. 2, the recess 44 includes a circular shape or configuration, however, other embodiments may include a recess of virtually any shape and still fall within the full spirit and scope of the present invention. For example, as described herein, the recess 44 of the first or male portion 40 of the attachment assembly is shaped and configured to receive or at least partially receive a collar 54 of the second or female portion 50. In this manner, the recess 44 and the collar 54 of at least one embodiment are cooperatively constructed or cooperatively sized and shaped such that the collar 54 is able to fit within or at least partially within the recess 44, for example, in a snug or movement restricting manner.

More specifically, the second or female portion 50 of the attachment assembly of at least one embodiment includes a collar 54 which may protrude or extend at least partially from the surrounding surface, such as the immediately surrounding bottom surface 24 of the main platform 20 or the immediately surrounding bottom surface 34 of a riser 30*a-d*. In particular, as previously mentioned, the collar 54 of the second or female portion 50 of the attachment assembly is cooperatively shaped and sized with the recess 44 of the first or male portion 40 of the attachment assembly such that when the first or male portion 40 is removably connected to the second or female portion, the collar 54 is at least partially engaged or disposed within the recess 44.

Figure 5:
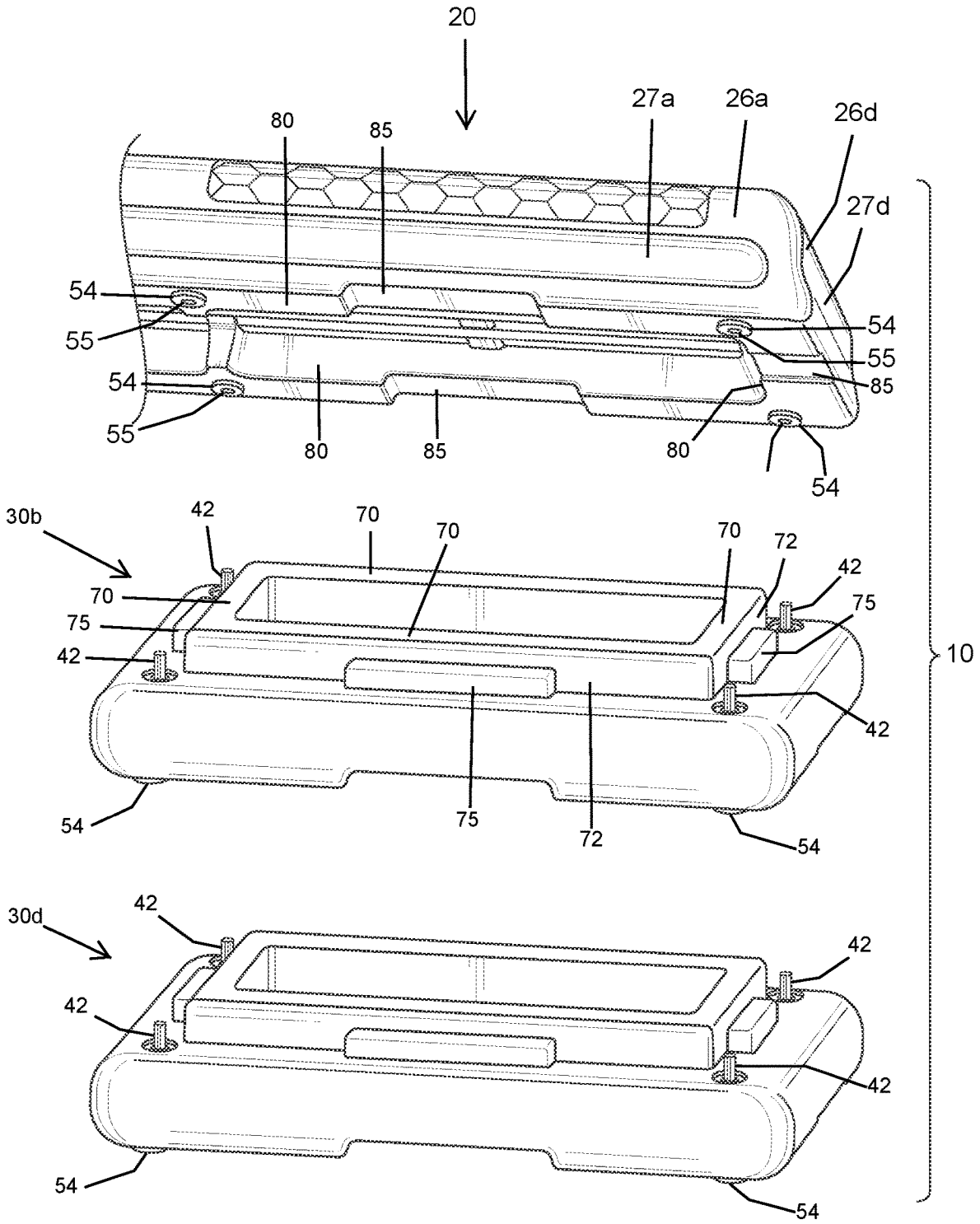
FIG. 5 is a partial cut-away and exploded view of the aerobic step platform assembly as disclosed in accordance with at least one embodiment of the present invention.
Figure 6:
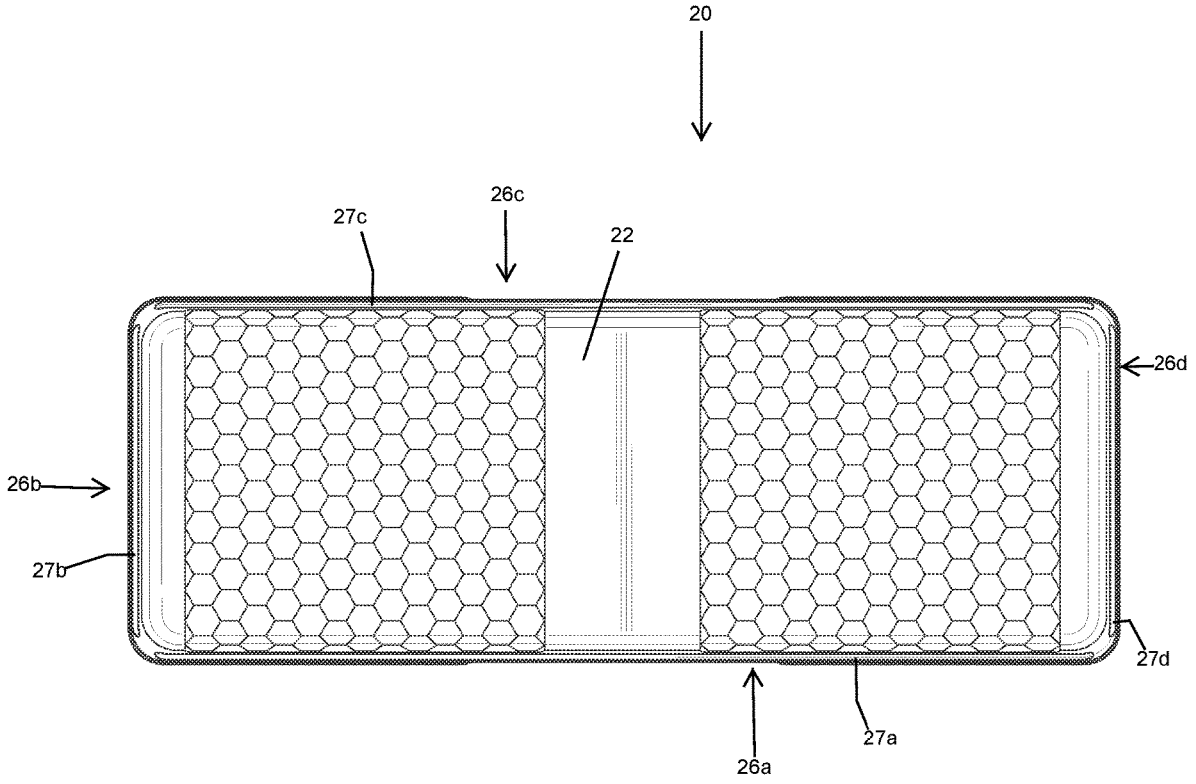
FIG. 6 is a top view of the main platform of the aerobic step platform assembly, as disclosed in accordance with at least one embodiment of the present invention.
Figure 7:
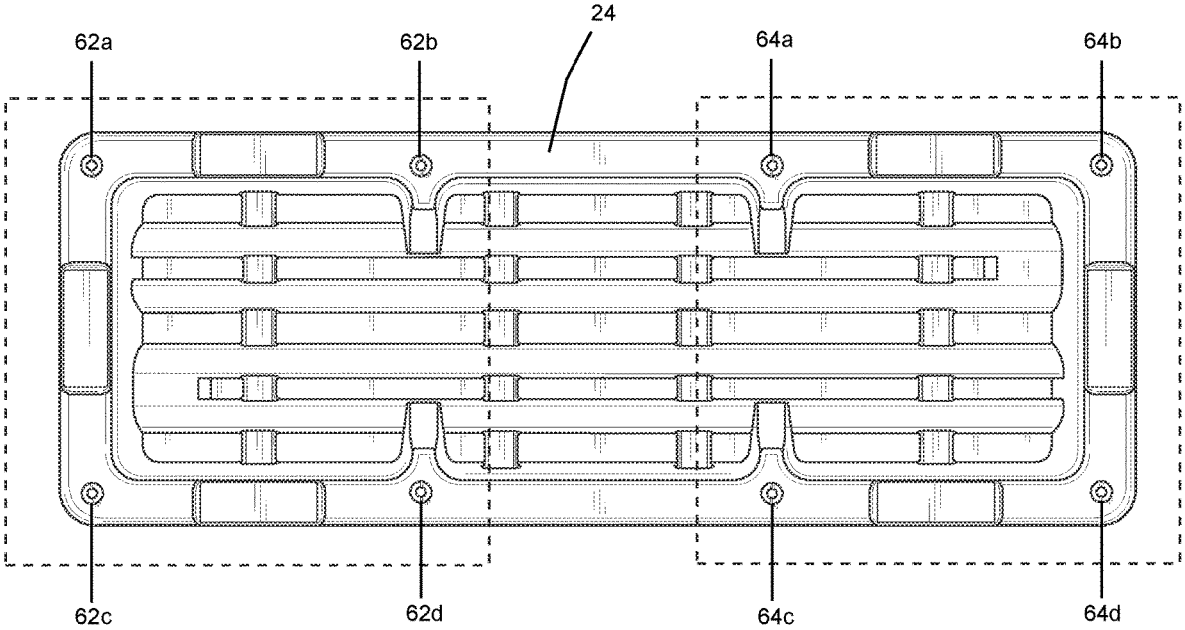
FIG. 7 is a bottom view of the main platform of the aerobic step platform assembly as disclosed in accordance with at least one embodiment of the present invention.

In addition, as shown in FIGS. 5 and 7, for example, the second or female portion 50 of the attachment assembly also defines a receiving hole, bore or channel 55 with at least one open end 55*a*. The receiving hole or channel 55 is cooperatively formed or constructed with the peg 42 of the first or male portion 40 such that the peg 42 is removably engaged or disposed within the hole 55 when the first or male portion 40 is removably connected to the second or female portion 50. In other words, the distal end 43 of the peg 42 will pass through the open end 55*a* of the receiving hole 55 allowing the peg 42 to engage within the hole 55.

In this manner, a removable connection between the first or male portion 40 and the second or female portion 50 of the attachment assembly is accomplished when the peg 42 of the first or male portion 40 is cooperative with or otherwise disposed or engaged within the receiving hole 55 of the second or female portion 50, and when the collar 54 of the second or female portion 50 is cooperative with or otherwise disposed or engaged within the recess 44 of the first or male portion 40. Such a cooperative engagement between with first or male portion 40 and the second or female portion 50 of the attachment assembly restricts lateral movement (e.g., side-to-side or front-to-back movement) between two engaged pieces (e.g., between the main platform 20 and a riser 30*a-d*, and/or between one riser and anther connected or stacked riser). The attachment assembly may be disengaged through axial movement of one piece relative to the other, for example, by axially pulling or separating the main platform 20 from a connected riser 30*a-d*, by axially pulling or separating a riser 30*a-d* from a connected main platform 20, or by axially pulling or separating one riser from another stacked or connected riser.

Figure 4:
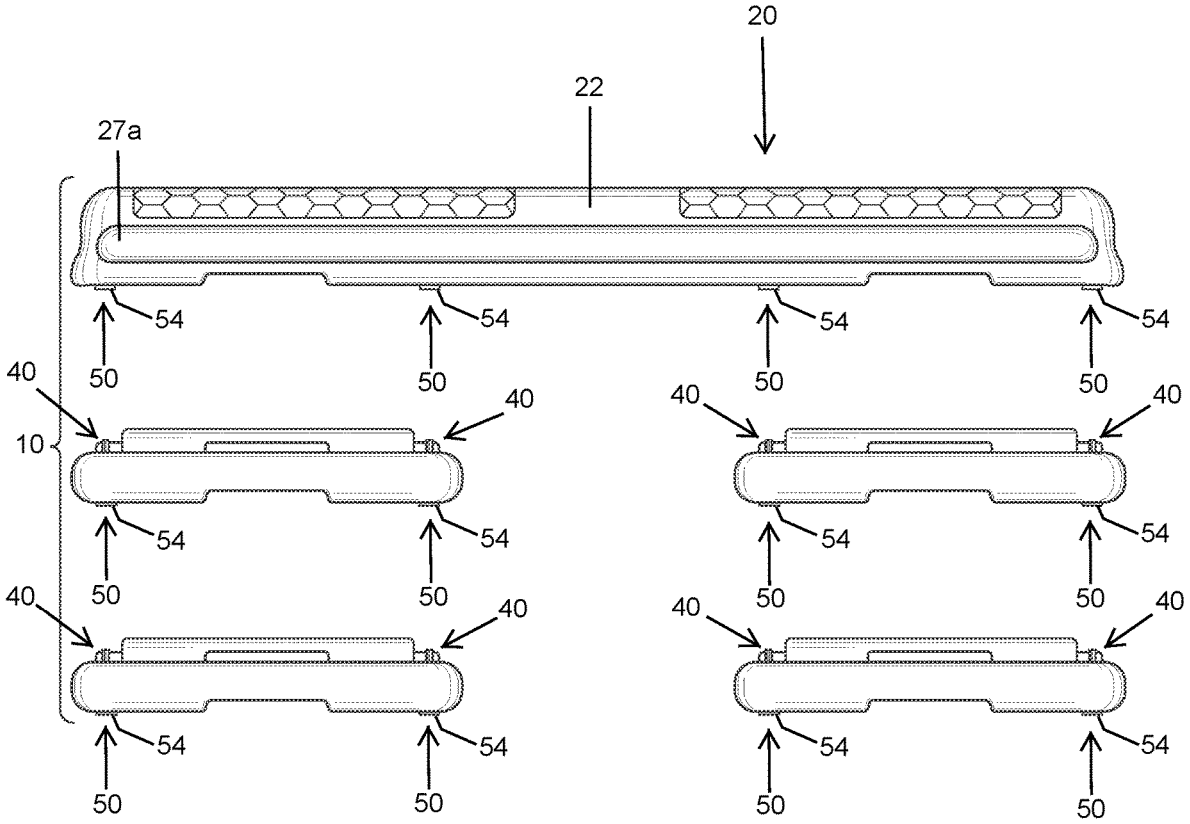
FIG. 4 is another exploded view of the aerobic step platform assembly as disclosed in accordance with at least one embodiment of the present invention.
Figure 8:
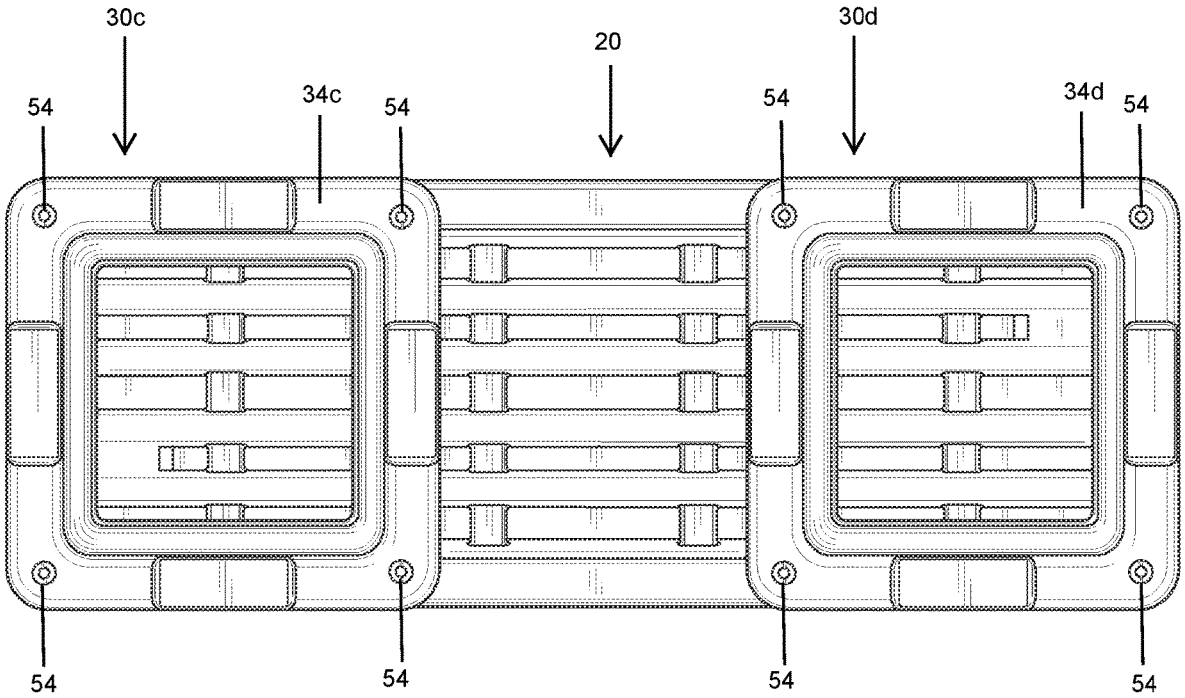
FIG. 8 is a bottom view of the aerobic step platform assembly as disclosed in accordance with at least one embodiment of the present invention.

Additionally, as mentioned herein, and as shown in the exemplary embodiment of FIGS. 2 and 4-8, the main platform 20 includes a plurality of second or female portions 50 of the attachment assembly disposed on the bottom surface 24 thereof, for removable connection with a plurality of first or male portions 40 that are disposed on the top attachment surface 32*a-d* of a corresponding riser 30*a-d*. Furthermore, as shown in FIGS. 4 and 8, in at least one embodiment, each of the risers 30*a-d* include a plurality of female portions 50 and/or collars 54 disposed on the bottom surfaces 34*a-d* thereof. The female portions 50 and/or collars 54 disposed on the bottom surfaces 34*a-d* of the risers 30*a-d* are cooperative with or otherwise removably engageable with the male portions 40. This allows the risers 30*a-d* to be selectively connectable to one another or otherwise stacked upon one another in order to change or adjust the height of the platform assembly 10. Of course, as mentioned above, a reverse configuration may be contemplated such that the top attachment surfaces 32*a-d* of the risers 30*a-d* are equipped with or include female portions and wherein the bottom surfaces 34*a-d* are equipped within or include male portions, as used herein.

It is also worth noting that, in at least one embodiment, each of the risers 30*a-d* are interchangeable and include identical constructions or configurations. In some embodiments, however, the risers 30*a-d* may be formed of or include differing heights to provide additional customization or height selection.

With reference to FIG. 7, a bottom view of the main platform 20 of at least one embodiment is shown. Particularly, in at least one embodiment, the main platform 20 includes a first set of attachment portions, generally referenced as 62*a-d* and a second set of attachment portions, generally referenced as 64*a-d*. As shown, the first set of attachment portions 62*a-d* are disposed on one side or on one half of the main platform 20, while the second set of attachment portions 64*a-d* are disposed on the other side or other half of the main platform 20. In this manner, the risers 30*a-d* each include a set of attachment portions (e.g., a plurality of first or male portions 40) which separately cooperate with the first set 62*a-d* and the second set 64*a-d* of attachment portions on the bottom of the main platform. More specifically, using the set of attachment portions on the top surface of the riser 30*a-d*, the riser 30*a-d* can be attached to the first set 62*a-d* or the second set 64*a-d* of the attachment portions on the bottom of the main platform 20.

In this manner, the first and second set of attachment portions 62*a-d*, 64*a-d* may be female portions 50 (as shown in the FIGS.) or, in an alternative embodiment, male portions 40. Of course, if the first and second set of attachment portions 62*a-d*, 64*a-d* are female portions 50, then the set of attachment portions on the top surface 32*a-d* of the risers 30*a-d* will be cooperative male portions 40, as shown in the Figures. Alternatively, if the first and second set of attachment portions 62*a-d*, 64*a-d* are male portions 40, then the set of attachment portions on the top surface 32*a-d* of the risers 30*a-d* will be cooperative female portions 50.

Furthermore, the attachment assembly of at least one embodiment may also include a third portion defined as another set of attachment portions formed on or included on the bottom surfaces 34*a-d* of the risers 30*a-d*. The third portions or set of attachment portions formed on the bottom surface 34*a-d* of the riser 30*a-d* is cooperative with the set of attachment portions that are formed on the top attachment surfaces 32*a-d* of the risers 30*a-d*. More specifically, if the set of attachment portions on the top attachment surfaces 32*a-d* of the risers are male portions 40, then the set of attachment portions on the bottom surfaces 34*a-d* of the risers 30*a-d* will be cooperative female portions 50, as shown in the Figures. Alternatively, if the set of attachment portions on the top attachment surfaces 32*a-d* of the risers 30*a-d* are female portions 50, then the set of attachment portions on the bottom surfaces 34*a-d* of the risers 30*a-d* will be cooperative male portions 50.

With reference now to FIGS. 9A-10B an exemplary peg 42 (FIGS. 9A and 9B) of the first or male portion 40 of the attachment assembly, and an exemplary grommet 52 defining the collar of the second or female portion 50 of the attachment assembly is shown.

Figure 9A:
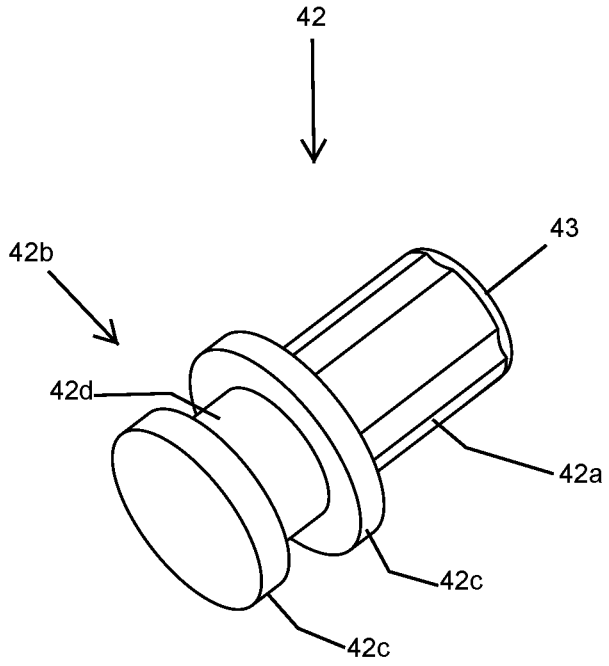
FIG. 9A is a perspective view of the peg of the first or male portion of the attachment assembly as disclosed in accordance with at least one embodiment of the present invention.

Particularly, with reference first to FIG. 9A, the peg 42 of at least one embodiment may be defined as including an exposed shaft 42*a* extending from a mounting base 42*b* and terminating at distal end 43. The mounting base 42*b* of at least one embodiment may include enlarged collars 42*c* separated by a recessed column 42*d*, although other structures and configurations of the mounting base 42*b* and/or peg 42 are contemplated within the full spirit and scope of the various embodiments of the present invention described herein. Particularly, the mounting base 42*b* operates to fixedly mount the peg 42 to the corresponding riser 30*a-d*. In this manner, the mounting base 42*b*, or a substantial portion of the mounting base 42*b*, may be embedded within or fixed to the body of the riser 30*a-d* with the exposed shaft 42*a* extending therefrom and terminating at the distal end 43.

Figure 10A:
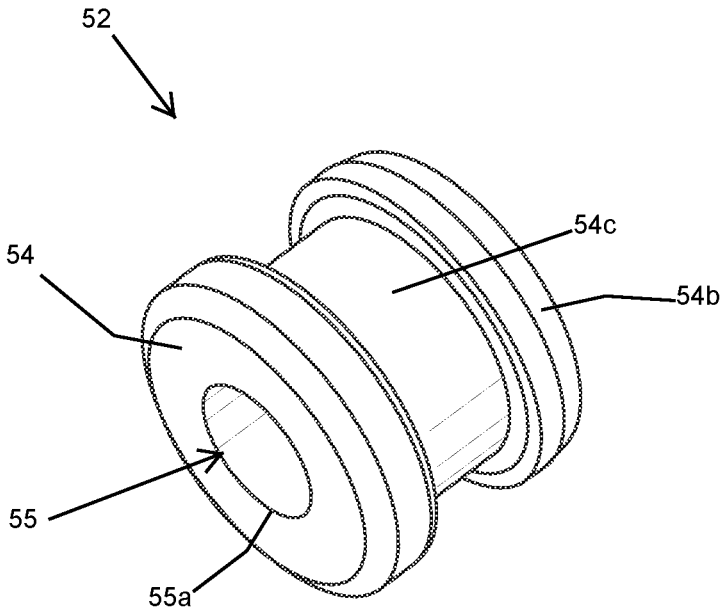
FIG. 10A a perspective view of the grommet of the second or female portion of the attachment assembly as disclosed in accordance with at least one embodiment of the present invention.

Referring now to FIG. 10A, the grommet 52 of at least one embodiment includes or otherwise defines the collar 54 and receiving hole 55 discussed herein with reference to the second or female portion 50 of the attachment assembly. In at least one embodiment, the grommet 52 also includes a mounting collar 54*b* and column 54*c*, as shown. Particularly, the mounting collar 54*b* and column 54*c* of at least one embodiment is structured such that the grommet 52 is fixed to or mounted to the corresponding main platform 20 and/or riser 30*a-d*. In this manner, the mounting collar 54*b* and the mounting column 54*c* may be embedded, at least partially embedded within or mounted to the body of the main platform 20 or riser 30*a-d* with the collar 54 extending therefrom in the manner described herein.

Figure 9B:
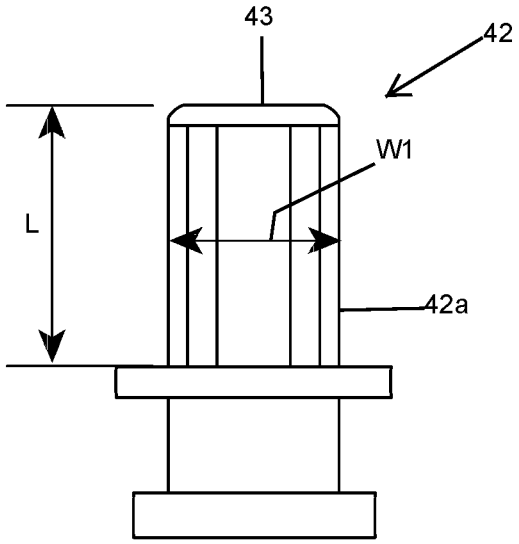
FIG. 9B is an elevation view of the peg of the first or male portion of the attachment assembly as disclosed in accordance with at least one embodiment of the present invention.
Figure 10B:
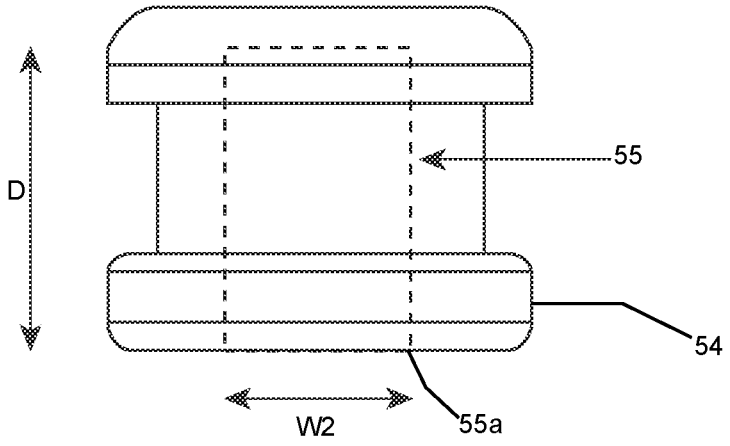
FIG. 10B an elevation view of the grommet of the second or female portion of the attachment assembly as disclosed in accordance with at least one embodiment of the present invention.

With reference to FIGS. 9B and 10B, elevation views of the peg 42 and grommet 52 of at least one embodiment are shown for purposes of illustrating some dimensions thereof. For example, the exposed shaft 42*a* of the peg 42 may include a length referenced as L and measured between the first collar 42*c* and the distal end 43. Similarly, the receiving hole 55 of the grommet 52 may include a depth D measured from the open end 55*a* to a bottom closed end 55*b* thereof. In an exemplary embodiment, the length L of the peg 42 or exposed shaft 42*a* thereof may be equal to, substantially equal to or be slightly less than the depth D of the receiving hole 55. As just an example, in at least one embodiment, the length L may be approximately fifteen millimeters (15 mm) while the depth D may be approximately sixteen millimeters (16 mm), although other lengths L and depths D greater or smaller are contemplated and still within the spirit and scope of the present invention.

Furthermore, and still referring to FIGS. 9B and 10B, the peg 42 and/or the exposed shaft 42*a* thereof may include a width that is sized to engage within or be disposed within the receiving hole 55 of the grommet 52. In this manner, the width W1 of the peg 42 may be equal to, substantially equal to, slightly more or slightly less than the width W2 of the receiving hole 55. More specifically, the peg 42 may be constructed of a rigid material, including but in no way limited to metal or a rigid plastic material, whereas the grommet 52 may be constructed of a resilient or pliable material such as, for example, rubber or other like material. Accordingly, the width W2 of the receiving hole 55 may be substantially equal to or slightly smaller than the width W1 of the peg 42, which allows the peg 42 to be securely connected to or engaged within the hole 55 to prevent or minimize inadvertent axial disconnection there between. As just an example, the width W1 of the peg 42 may be approximately ten millimeters (10 mm), whereas the width W2 of the hole 55 may be approximately 9.7 millimeters (9.7 mm), although other widths W1, W2 are contemplated.

Additional features of at least one embodiment of the present invention include one or more nesting components which cooperatively allow the riser(s) 30*a-d* to nest, mate or telescopically connect with the bottom surface of the main platform 20 and/or with another stacked riser. In particular, with reference again to FIGS. 2 and 5, the risers 30*a-d* of at least one embodiment include at least one raised wall referenced as 70 extending from the top attachment surface 32*a-d*. In some embodiments, the raised wall 70 is a continuous wall disposed around the perimeter of an interior opening or defining an interior opening although other configurations are contemplated. In this manner, as shown in FIG. 5, for example, the bottom surface 24 of the main platform 20 includes a corresponding recess defined by walls 80 within which the raised walls 70 of the risers 30*a-d* are nested. For example, the outer surfaces 72 of raised walls 70 will face or nest with the inner surfaces of walls 80. This nesting feature further restricts lateral movement of the riser(s) 30*a-d* during operation of any exercises upon the platform assembly 10.

Furthermore, in some embodiments, one or more additional walls or steps 75 may also extend from the top attachment surfaces 32*a-d* of the risers 30*a-d*, for example against or adjacent outside surfaces 72 of walls 70. In the embodiment shown, the additional walls or steps 75 are shorter in height when compared to the wall(s) 70, although other configurations are contemplated.

Furthermore, still referring to FIG. 5, the main platform 20 of at least one embodiment of the present invention includes corresponding recesses or indents 85 that mate or nest with the additional walls or steps 75. The mating or nesting walls 75 and recesses 85 provide additional restrictions upon lateral movements of the connected platform 20 and riser 30*a-d*, for example, during use.

Similarly, it should be noted that the risers 30*a-d* of at least one embodiment, and in particular, the underside thereof, include corresponding walls and recesses that cooperatively mate or nest with the raised walls or seps 70, 75 of another riser 30*a-d*. In particular, the underside of the risers 30*a-d* of at least one embodiment of the present invention, include an inner recess to receive raised wall(s) 70 of a stacking riser, and edge recesses 95 to receive the additional step or walls 75. In this manner, stacked risers can be nested with one another in order to restrict lateral movement there between during operation of the platform assembly 10 of the present invention.

With reference again to FIGS. 1-6, yet another feature of at least one embodiment of the present invention includes one or more recessed channels, referenced as 27*a-d*, disposed on or along one or more of the peripheral edges or walls 26*a-d* of the main platform 20. More specifically, the recessed channels 27*a-d* can be used by an individual or exerciser as a hand grip or finger hold during the performance of an exercise using the platform assembly 10 of the present invention. For instance, with the user's palm on the top surface 22 or on the edge between the top surface 22 and the peripheral wall 27*a-d*, the user can grip the platform 20 by engaging or placing his or her fingers within the one or more recessed channels 27*a-d*. Such a position can be helpful for the user to maintain his or her position or balance during use of the platform assembly 10 in various manners. As just an example, the user or exerciser may grip onto the platform 10 in the manner described above using the recessed channel(s) 27*a-d* in order to perform push-ups, lunges, stretches, or other various exercises.

Accordingly, in at least one embodiment, the main platform 20 may include elongated recessed 27*a-d* along each of the peripheral edges or walls 26*a-d*, although in some embodiments, one or more of the peripherals edges or walls 26*a-d* may not include a recessed channel.

In the embodiment shown, for example, recessed channel 27*a* is disposed on corresponding peripheral wall 26*a* and extends substantially the entire length of the longitudinal peripheral wall 26*a*, allowing the user or exerciser to form a grip in the manner disclosed above in substantially any position along the length of the wall 26*a*. It should be noted, however, that in other embodiments, the recessed channel 26*a* may be substantially smaller, may extend along only a portion of the wall 26*a*, or may be sectioned such that the wall 26*a* may include a plurality of recessed channels spaced there along.

Similarly, recessed channel 27*b* is disposed on corresponding lateral or end peripheral wall 26*b* and extends substantially the entire length of the lateral or end peripheral wall 26*b*, allowing the user or exerciser to form a grip in the manner disclosed above in substantially any position along the length of the wall 26*b*. It should be noted, however, that in other embodiments, the recessed channel 26*b* may be substantially smaller, may extend along only a portion of the wall 26*b*, or may be sectioned such that the wall 26*b* may include a plurality of recessed channels spaced there along.

Further, recessed channel 27*c* is disposed on corresponding longitudinal peripheral wall 26*c* and extends substantially the entire length of the peripheral wall 26*c*, allowing the user or exerciser to form a grip in the manner disclosed above in substantially any position along the length of the wall 26*c*. It should be noted, however, that in other embodiments, the recessed channel 26*c* may be substantially smaller, may extend along only a portion of the wall 26*c*, or may be sectioned such that the wall 26*c* may include a plurality of recessed channels spaced there along.

Finally, recessed channel 27*d* is disposed on corresponding lateral or end peripheral wall 26*d* and extends substantially the entire length of the lateral or end peripheral wall 26*d*, allowing the user or exerciser to form a grip in the manner disclosed above in substantially any position along the length of the wall 26*d*. It should be noted, however, that in other embodiments, the recessed channel 26*d* may be substantially smaller, may extend along only a portion of the wall 26*d*, or may be sectioned such that the wall 26*b* may include a plurality of recessed channels spaced there along.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. An aerobic step platform assembly, comprising:

a main step platform comprising a top surface and a bottom surface, a plurality of risers each comprising a top attachment surface and a bottom surface, said main step platform comprising a plurality of collars extending from said bottom surface of said main step platform, each of said plurality of collars comprising a receiving hole disposed therein, each of said plurality of risers comprising a plurality of pegs and a plurality of surrounding recesses, wherein each of said plurality of pegs comprises a mounting base and a shaft, said mounting base being fixedly mounted to a corresponding one of said plurality of risers with said shaft extending from a corresponding one of said plurality of surrounding recesses, wherein said mounting base comprises at least two enlarged collars separated by a recessed column, wherein each of said plurality of pegs is removably disposable at least partially within a corresponding one of said plurality of receiving holes of said plurality of collars extending from said bottom surface of said main step platform, and wherein said plurality of collars are cooperatively sized with said plurality of surrounding recesses such that when said plurality of pegs of one of said plurality of risers are disposed within said receiving holes of corresponding ones of said plurality of collars, said corresponding ones of said plurality of collars are removably disposed in a movement restricting manner within said surrounding recesses of said corresponding ones of said plurality of collars.

2. An aerobic step platform assembly, comprising:

a main step platform comprising a top surface and a bottom surface, a plurality of risers each comprising a top attachment surface and a bottom surface, a plurality of attachment assemblies, each comprising:

a first portion and a second portion, said first portion and said second portion being cooperatively removably coupled to one another, said first portion comprising a peg and a surrounding recess, said peg comprising a mounting base and a shaft, said peg being fixedly mounted within said surrounding recess via said mounting base with said shaft being coaxial with and extending from said surrounding recess, wherein said mounting base comprises at least two enlarged collars separated by a recessed column, said second portion comprising a collar protruding from a surrounding surface and defining a receiving hole disposed therein, wherein said peg of said first portion is removably disposable at least partially within said receiving hole of said collar of said second portion, wherein said collar of said second portion and said surrounding recess of said first portion are cooperatively sized such that when said peg is disposed at least partially within said receiving hole of said collar, said collar is removably disposed within said surrounding recess of said first portion, wherein said bottom surface of said main step platform comprises a first set of attachment portions disposed on one half of said main step platform and a second set of attachment portions disposed on another half of said main step platform, said first set of attachment portions and said second set of attachment portions each comprise a plurality of said second portions of said attachment assemblies, wherein said surrounding surface is on said bottom surface of said main platform, wherein each of said plurality of risers comprise a set of first portions of said attachment assemblies disposed on said top attachment surface, wherein said set of first portions disposed on said top attachment surface of said risers is selectively attachable with said first set of attachment portions on said bottom surface of said main step platform, and wherein said set of first portions disposed on said top surface of said risers is also separately attachable with said second set of attachment portions on said bottom surface of said main step platform.

3. The aerobic step platform assembly as recited in claim 2 wherein said attachment assemblies further comprise a third portion, wherein said bottom surface of each of said plurality of risers comprises a set of a plurality of said third portions removably connectable to a set of first portions disposed on a top surface of another one of said plurality of risers.

4. The aerobic step platform assembly as recited in claim 3 wherein said at least one peg of said first portion of each of said attachment assemblies comprises a distal end that extends beyond a top edge of said surrounding recess.

5. The aerobic step platform assembly as recited in claim 4 wherein said surrounding recess comprises a depth and said a least one peg comprises a length, said length of said peg being greater than said depth of said surrounding recess.

6. The aerobic step platform assembly as recited in claim 2 wherein said main step platform comprises a plurality of peripheral walls, wherein at least one of said plurality of peripheral walls comprises an elongated recessed channel disposed thereon, said elongated recessed channel being configured to provide a finger hold for a user during performance of an exercise.

* * * * *